US005833071A

United States Patent [19]

Ray

[11] Patent Number: 5,833,071

[45] Date of Patent: Nov. 10, 1998

[54] PUNCTURABLE ENTRY-RESISTANT PACKAGE FOR LOW DENSITY TABLETS

[75] Inventor: Thomas O. Ray, Richmond, Va.

[73] Assignee: Fuisz Technologies Ltd., Chantilly, Va.

[21] Appl. No.: 887,429

[22] Filed: Jul. 2, 1997

[51] Int. Cl.[6] ..... B65D 83/04

[52] U.S. Cl. ..... 206/532; 206/469

[58] Field of Search ..... 206/467, 469, 206/531, 532, 538, 539; 220/277; 383/202

[56] References Cited

U.S. PATENT DOCUMENTS

| | | | |
|---|---|---|---|
| 3,054,503 | 9/1962 | Hartman, Jr. et al. | 206/531 |
| 3,246,746 | 4/1966 | Holley | 206/65 |
| 3,659,706 | 5/1972 | Serrell | 206/56 AB |
| 3,737,029 | 6/1973 | Serrell et al. | 206/56 AB |
| 3,924,747 | 12/1975 | Gerner | 206/531 |
| 3,933,245 | 1/1976 | Mullen | 206/532 |
| 3,941,248 | 3/1976 | Moser et al. | 206/532 |
| 4,266,666 | 5/1981 | Kuchenbecker | 206/461 |
| 4,574,954 | 3/1986 | Reid | 206/532 |
| 4,838,425 | 6/1989 | O'Brien et al. | 206/531 |
| 4,911,304 | 3/1990 | Bunin | 206/531 |
| 5,014,851 | 5/1991 | Wick | 206/539 |
| 5,172,812 | 12/1992 | Wharton et al. | 206/531 |
| 5,325,968 | 7/1994 | Sowden | 206/534.2 |

*Primary Examiner*—Jim Foster
*Attorney, Agent, or Firm*—Richard D. Schmidt

[57] ABSTRACT

A child resistant tablet package accommodates low density pharmaceutical tablets. The package includes a blister tray having a planar surface and a plurality of spaced apart open ended tablet accommodating first blister depressions formed therein. A plurality of entry facilitating second blister depressions are provided on the planar surface spaced adjacent each first blister depression. A planar lid is removably sealed over the planar surface of the blister tray and includes portions overlying disposed over the first and second blister depressions. The lid is puncturable through the plane of the lid at a location over the second blister depressions so as to facilitate removal of portions of the lid overlying the first blister depressions so as to expose the tablets for dispensing.

9 Claims, 3 Drawing Sheets

10
23
12
24
20
24b
16
29
16b
15
24
16a
14
14b
14a

PUNCTURABLE ENTRY-RESISTANT PACKAGE FOR LOW DENSITY TABLETS

FIELD OF THE INVENTION

The present invention relates generally to packages for containing tablets. More particularly, the present invention relates to child-resistant blister packaging for containing and dispensing tablets where the blister packaging inhibits undesirable entry and yet permits the dispensing of tablets that may be fragile without damage thereto.

BACKGROUND OF THE INVENTION

It is well known to use blister packaging to contain items such as pharmaceutical tablets or capsules. Conventional blister packages include a blister tray which is typically a thermo formed plastic sheet having a plurality of blister depressions or cells formed therein. A sealable cover, or lid stock is placed in overlying disposition over the blister trays to enclose the tablets contained within the individual blister depressions. The cover stock is typically sealed to the blister tray providing environmental protection thereto. The blister package provides some degree of protection to the tablets during shipping and storage and also provides for the convenient dispensing of the individual tablets from the package.

Removal of tablets from the blister package may be accomplished in one of two conventional techniques. The first technique is to provide a lid stock which is supported over the blister tray in a manner where the blister lid can be easily removed from the blister tray providing ready access to the tablets contained in the blister depressions. In such embodiments the lid stock is adhesively sealed to the blister tray by a non-aggressive adhesive so that the lid stock may be easily peeled from the blister tray so as to permit removal of the tablets. In such situations a non-sealed peel tab may be established adjacent one edge of the blister tray to facilitate manual peeling of the lid. Examples of blister packages having removable lids disposed adhesively over a blister tray are shown in U.S. Pat. Nos. 3,246,746 to Holley; 3,659,706 to Serrell; and 3,737,029 to Serrell et al.

The second technique for permitting the removal of tablets from a blister package is to provide a readily rupturable lid over the blister tray. Such lid is formed of a laminated material which may be easily ruptured by manually deforming the blister depression and forcing the tablet through the lid. In such embodiments the tablet is removed from the blister package by manually pushing against the blister depression and forcing the tablet held in the depression through the rupturable lid. The lid may be sufficiently thin and flexible so as to permit the passage of a conventional tablet or capsule therethrough with damaging the tablet. Examples of such push-through blister packages are shown in U.S. Pat. No. 3,924,747 to Gerner and U.S. Pat. No. 4,911,304 to Bunin.

Various other blister packages having rupturable and/or peelably removable lids are shown in U.S. Pat. Nos. 4,838,425 to O'Brien et al. and 5,172,812 to Wharton et al.

While the above-described techniques for storing and dispensing pharmaceutical tablets using lid stock and trays serve adequately for their intended purposes, there are certain inherent drawbacks in such designs. In both the peelable design and in the push-through design, the removal of the tablet from the package is easily accomplished. In the peelable lid design, the adhesive which holds the lid to the blister tray is relatively non-aggressive and a tab is provided which facilitates easy peelable removal of the lid from the tray. In the push-through design, the lid is formed of relatively thin and flexible material so as to permit the easy puncturing of the lid by the tablet without destroying the tablet.

As may be appreciated, neither of these basic designs is particularly child-entry resistant. Thus, a child would be capable of readily dispensing the tablet from the package. Techniques to make such blister packages sufficiently child-entry resistant are currently under development. However, certain of these techniques have been found to be unacceptable in certain situations. Many child resistant packages have been designed which require significant force and manual dexterity so as to render the tablet inaccessible to a child. Such devices however have resulted in rendering the package difficult to open even by adults. Also, specifically with respect to push-through type packages where the tablet must be forced through the lid, the push-through action may result in destruction of the tablet itself especially in situations where low density porous tablets are employed. This destruction renders the tablet unusable.

It is therefore desirable to provide an improved blister package design which can accommodate a low density pharmaceutical tablet, yet where the blister package is adequately child-entry resistant and yet simple and easy to open by an adult without damage to the tablet.

SUMMARY OF THE INVENTION

It is an object of the present invention to provide a tablet package for protecting and dispensing tablets.

It is a further object of the present invention to provide a child entry resistant blister packaging for containing and dispensing tablets.

It is a still further object of the present invention to provide child entry resistant blister packaging for containing and dispensing tablets which is adequately child entry resistant yet is simple and easy to use by an adult without damaging fragile tablets which may be contained therein.

In the efficient attainment of these and other objects, the present invention provides an entry resistant tablet package for accommodating tablets. The package includes a blister tray having a planar surface including a plurality of spaced apart open ended tablet accommodating first blister depressions and a plurality of entry facilitating second blister depressions. Each second blister depression is spaced adjacent to one of the first blister depressions. A planar lid is sealed over the planar surface of the blister tray. The lid includes portions thereof in overlying disposition with respect to the first and second blister depressions. The lid is puncturable through the plane of the lid at a location over the second blister depression. The puncturable location facilitates removal of portions of the lid from their overlying disposition with respect to the first blister depressions so as to expose the tablets for dispensing.

As more particularly described by way of the preferred embodiments herein, the package assembly permits access to the tablets contained therein yet is child entry resistant in that a given degree of puncturable force is necessary to establish a peel-tab. However, such force is applied away from the tablet so as to protect the fragile porous tablet. Furthermore, in order to effectively puncture the lid, a puncture tool must be employed. The punctured lid may be totally, or partially removed from the blister tray, or remained of the lid stock thereby exposing the tablet. In the alternative, the puncture may initiate a peel tab in the lid to enable the user to peel a portion of the lid away from the blister depression.

DETAILED DESCRIPTION OF THE PREFERRED EMBODIMENT

Figure 1:
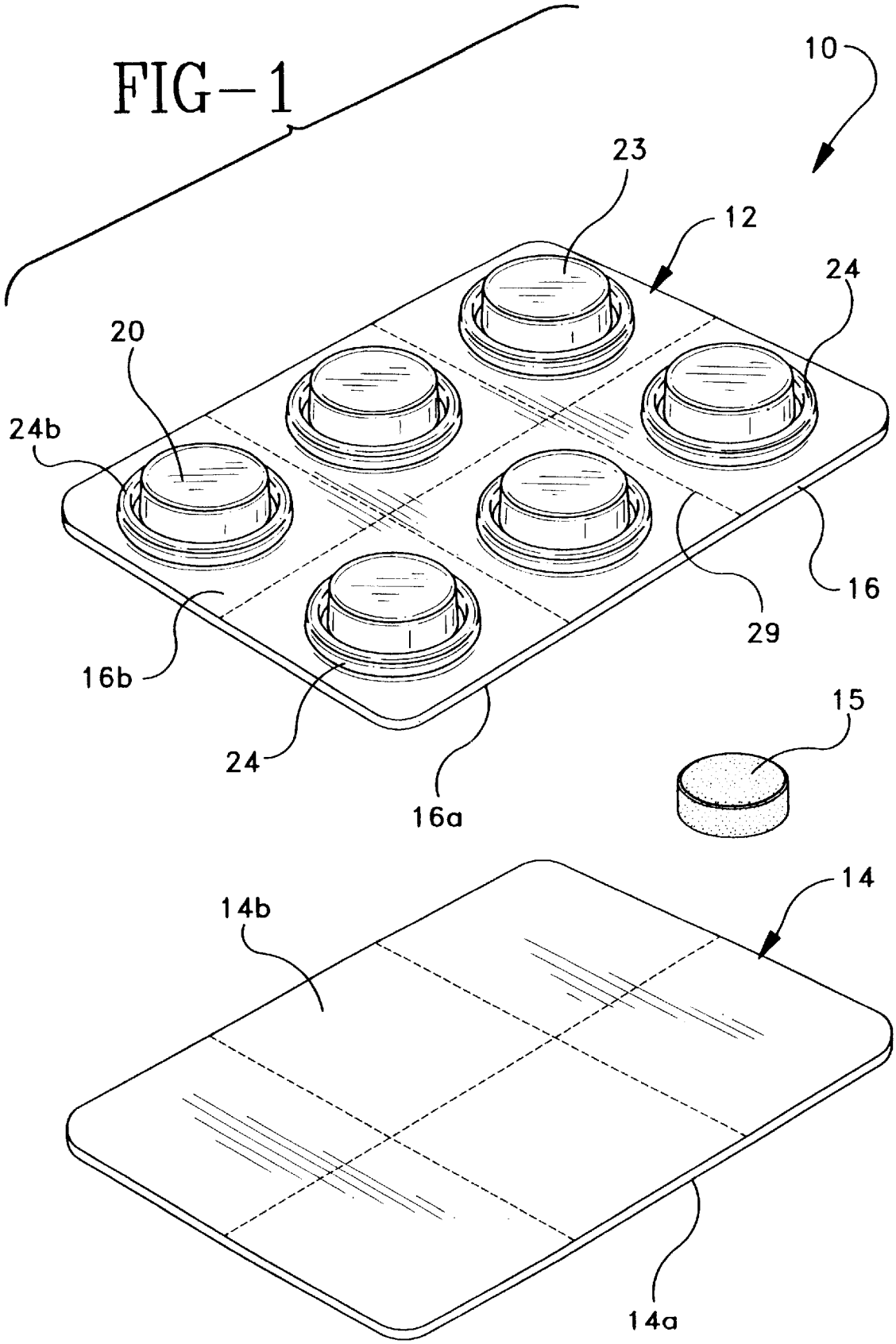
FIG. 1 is an exploded top perspective view of the tablet package assembly of the present invention showing a lid disposed over a blister tray for accommodating tablets.

The present invention provides a novel package for accommodating and dispensing tablets such as pharmaceutical tablets. The package of the present invention provides a child-resistant package in that the assembled construction of the package makes it difficult for the typical child to apply the force necessary to remove the tablet from the package and/or requires significant manual dexterity to remove the tablet from the package which would not ordinarily be within the range of the typical child.

The present invention also provides a child-resistant package for low density tablets, that is, tablets having a porous low density structure rendering the tablet relatively fragile.

Referring now to the drawings, a package assembly for accommodating and dispensing pharmaceutical tablets in accordance with the present invention may now be described.

Referring specifically to FIGS. 1–4, the package assembly of the present invention is shown. The tablet package assembly 10 includes a blister tray 12 and a lid 14 which may be positioned over blister tray 12 to accommodate tablets 15 therebetween.

Blister tray 12 is generally a thermo formed plastic member typically formed of water vapor impermeable or resistant plastic such as known in the art. Further, blister tray 12 may generally be transparent so as to allow viewing of tablets 15 contained therein. However transparency is not necessary. Blister tray 12 includes a generally planar portion 16 having a first planar surface 16*a* and opposed second planar surface 16*b*. A plurality of tablet accommodating first blister depressions 20 are formed in planar portion 16. As particularly shown in FIG. 3, each first blister depression 20 includes an open end 21 opening towards first surface 16*a* of planar portion 16 and a closed lower end 23 which extends below the second surface 16*b* of planar portion 16. The first blister depressions 20 are formed to have the general size and configuration of tablet 15 which is contained therein. The first blister depressions 20 may be arranged in any number or array desirable. However, as is common with respect to pharmaceutical tablet packaging, the first blister depressions are typically arranged in aligned rows and columns. The aligned rows and columns of first blister depressions may further be defined and separated by package perforations 29 which can divide the first blister depression 20 into individual tablet containing units. This allows an individual packaged tablet to be removed from the remainder of the package assembly 10.

Blister tray 12 further includes a plurality of entry facilitating second blister depressions 24. Each of the second blister depressions is generally an annularly formed depression which can circumscribe, in circumferentially spaced fashion, each tablet accommodating first blister depression 20. The space between first blister depression 20 and second blister depression 24 defines an annular planar location 35 co-extensive with planar surface 16*a*. As shown further in FIG. 3, each second blister depression 24 includes an open end 24*a* opening towards first surface 16*a* of planar portion 16 and an opposed closed lower end 24*b* which extends below the second surface 16*b* of planar portion 16. While the entry facilitating second blister depression 24 are each shown surrounding each first blister depression 20, other configurations where the second blister depressions are each spaced adjacent to the first blister depressions may also be employed.

As will be further described hereinbelow, entry facilitating second blister depressions 24 are provided to allow puncturable access through lid 14. Accordingly, in the preferred embodiment of the present invention, the depth of second blister depression 24 as measured from planar surface 16 need not be as great as the depth of first blister depression 20 which accommodates the tablet 15. It is only necessary that second blister depression 24 be sufficiently deep so as to permit puncturable access thereinto.

Tablet package assembly 10 of the present invention provides lid 14 in sealed overlying disposition with respect to blister tray 12. Lid 14 can generally be a thin flexible planar member having opposed surfaces 14*a* and 14*b*. The surface of 14*b* is positioned for sealed engagement with first surface 16*a* of blister tray 12. Lid 14 may be formed of a paper, foil or plastic sheet or laminated combinations thereof. In the present illustrative embodiment, lid 14 is formed of a paper/foil/plastic laminate where a paper sheet defines surface 14*a* and a foil sheet defines surface 14*b*. The composite laminate is generally water vapor impervious.

Surface 14*b* of lid 14 is typically adhered to first surface 16*a* of planar portion 16 of blister tray 12 by use of a heat sensitive adhesive 13. Such adhesive may be typically applied to the surface 14*b* of lid 14. The adhesive 13 is a type which may permit peelable removal of a portion of lid 14, once punctured, therefrom. Lid 14 includes an annular lid portion 30 which directly overlies each of the open ends 24*a* of second blister depression 24. Lid 14 also defines tablet covering portions 40 directly overlying each open end 21 of first blister depressions 20.

Figure 3:
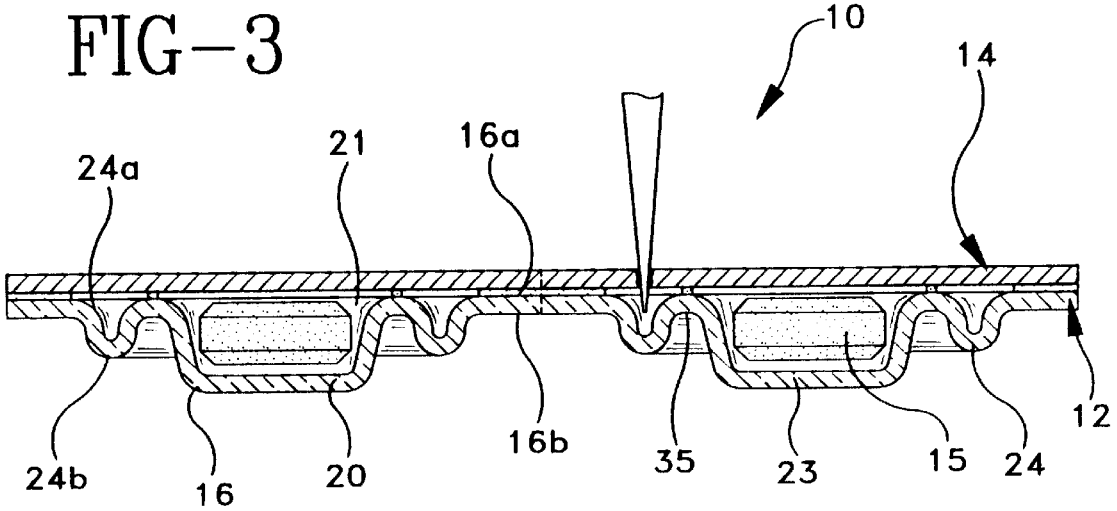
FIG. 3 is a cross-sectional view of the package assembly of FIG. 2 taken through the lines 3—3 thereof.

In convention fashion well-known in the tablet packaging art, tablet package assembly 10 of the present invention is assembled by inserting pharmaceutical tablets 15 within first blister depressions 20 of blister tray 12. Lid 14 is then adhesively secured to blister tray 12 to fully environmentally seal tablets 15 within package 10. However, the lid 14 may or may not be adhesively sealed at annular location 35 (FIG. 3). As an alternative, the adhesive employed may provide for a peelable, removable seal at annular location 35.

Figure 2:
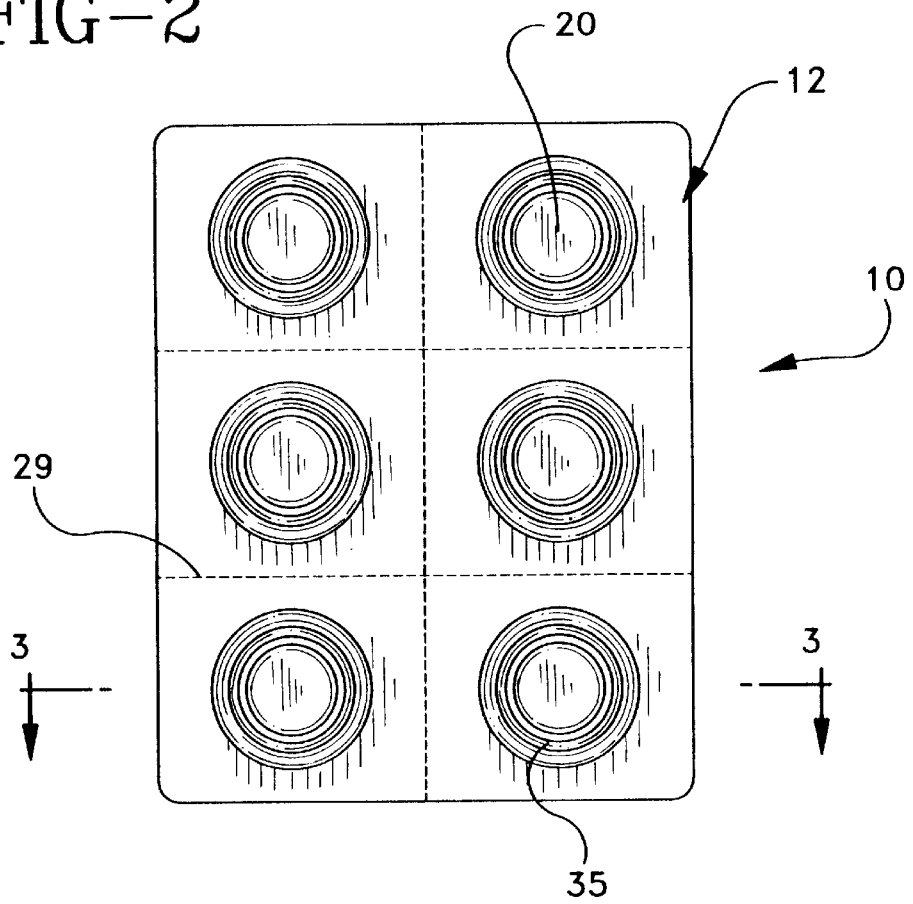
FIG. 2 is a top plan view of the tablet package assembly of FIG. 1.
Figure 4:
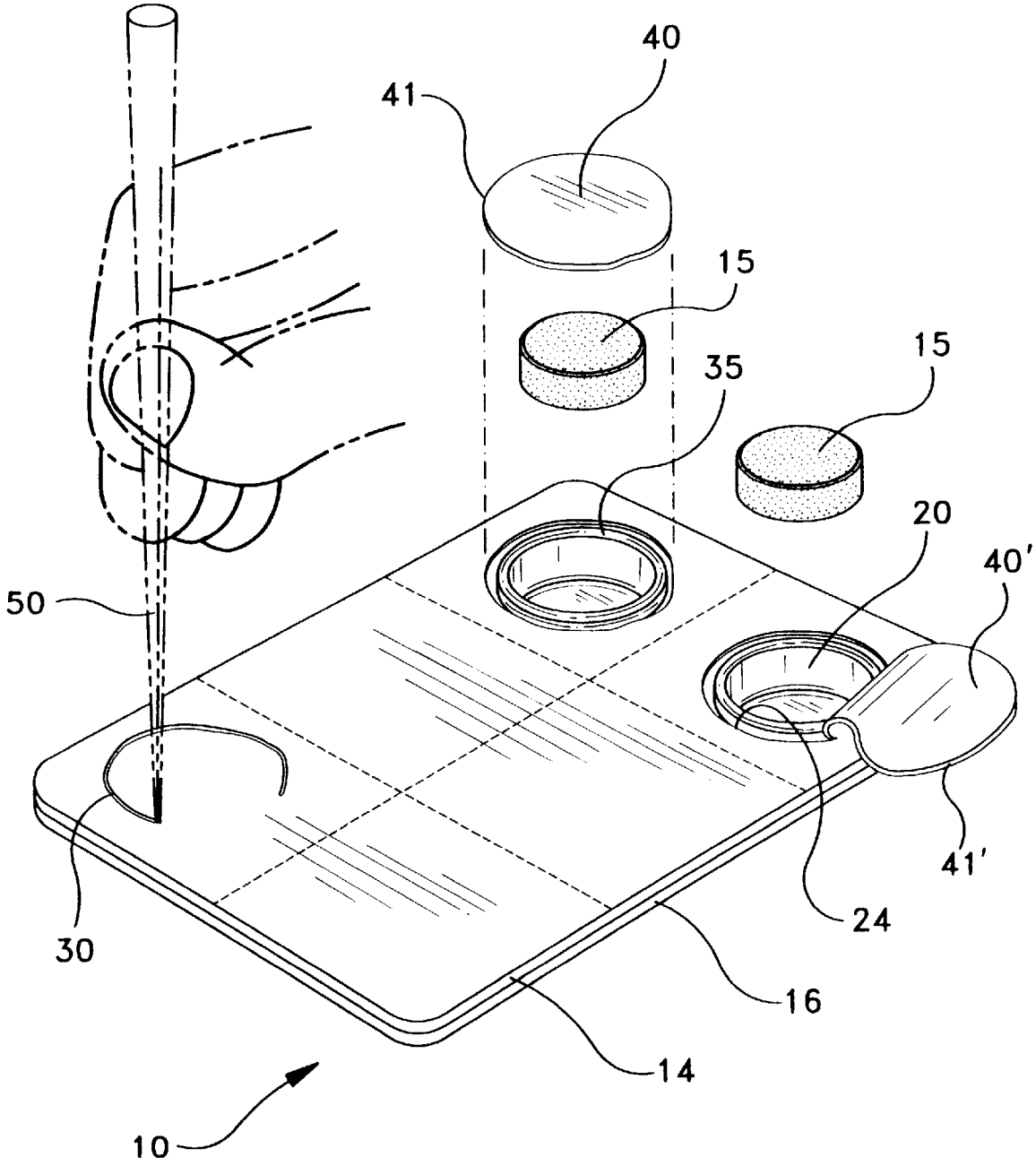
FIG. 4 is a bottom perspective showing of the assembled tablet package of FIG. 1 with portions thereof removed exposing tablets for dispensing.

The dispensing of an individual tablet 15 from the tablet package assembly 10 may be describe with respect to FIGS. 2–4. In order to dispense an individual tablet 15 from one of the first blister depressions 20 of tablet package assembly 10, an appropriate pointed probe-type tool 50 may be manually inserted through the defined annular lid puncture portion 30 which overlies the open end 24*a* of second blister depression 24. The tool 50 which may be any conveniently available household pointed object such as knife, pen, probe or similar instrument, including a fingernail, punctures through puncturable lid portion 30 and into second blister depression 24. The pointed tool 50 may be then be run around the annular blister depression 24 in a track like manner to effect lid puncturing circumferentially about first blister 20. Such circumferential puncturing provides a circumferential perforated edge 41 defining interiorly thereof tablet covering portion 40. The generally circular tablet covering portion 40 may be lifted from blister depression 20 by grasping edge 41 so as to render accessible tablet 15 contained therein. Or the package may be inverted over an open hand thereby depositing the tablet in the hand of the user.

It is further contemplated that the puncturing of lid portion 30 need not be achieved entirely circumferentially around blister depression 20. As shown in FIG. 4, the probe 50 may only be inserted partially circumferentially about second blister depression 24 to form a tablet covering tab portion 40' partially attached to the remainder of lid 14. The tablet covering tab portion 40' may be peelably removed from blister 20 by grasping punctured edge 41' thereby rendering access to tablet containing depression 20 and tablet 15 contained therein. Again, the tablet may be retrieved by inverting the package so as to remove the tablet therefrom.

The embodiment of the present invention also provides for the removal of fragile tablet 15 by puncturing the lid at a location spaced from the tablet containing blister depression 20. This prevents destruction of the fragile tablet during the removal process. Furthermore, as a certain degree of manual dexterity is required to effect removal of the tablet in the present embodiment, such removal is rendered difficult to achieve by the typical child.

Various changes to the foregoing described and shown structures would now be evident to those skilled in the art. Accordingly, the particularly disclosed scope of the invention is set forth in the following claims.

What is claimed is:

1. An entry resistant tablet package for accommodating tablets comprising:

a blister tray having a first and second planar surface including a plurality of spaced-apart, open-ended tablet accommodating first blister depressions formed therein, and a plurality of entry facilitating second blister depressions, each second blister depression being associated with and spaced circumferentially about one of said first blister depressions, said first and second blister depressions opening onto said first planar surface and having an annular planar location co-extensive with said first planar surface therebetween; and a planar lid sealed to said planar surface of said blister tray and having portions overlyingly disposed over said first and second blister depressions, said lid being puncturable through the plane of said lid at a location over said second blister depressions.

2. A tablet package of claim 1 wherein said lid is formed of a multi-component laminate structure.

3. A tablet package of claim 2 wherein said tray is formed of a thermo formed plastic.

4. A tablet package of claim 1 wherein said first blister depression extends a first depth from said planar surface and said second blister depression extends a second depth from said planar surface and wherein said first depth is greater than said second depth.

5. A tablet package of claim 1 wherein said puncturable lid location extends about said first blister depression for facilitating severed removal of said portion of said lid overlying said first blister depression.

6. A tablet package of claim 1 wherein said planar lid is removably sealed to said blister tray.

7. A tablet package of claim 1 wherein said second blister depression extends at least partially parametrically bounds said annular, co-extensive planar location.

8. A child-resistant tablet package comprising:

a blister tray having a planar surface defining a first tablet accommodating blister depression, a second probe accessible blister spaced circumferentially about said first blister depression and an annular planar location co-extensive with said planar surface located between said first and second blister depressions; and a lid overlying and covering said first and second blister depressions, said lid being puncturable by a probe.

9. A child-resistant tablet package of claim 8 wherein said second blister depression extends at least partially parametrically bounds said annular planar location.

* * * * *